US006745596B2

(12) United States Patent
Wueste

(10) Patent No.: US 6,745,596 B2
(45) Date of Patent: Jun. 8, 2004

(54) PRINCESS CUT DIAMOND

(75) Inventor: Robert J. Wueste, Oceanside, CA (US)

(73) Assignee: Samuel Aaron, Inc., Long Island City, NY (US)

( * ) Notice: Subject to any disclaimer, the term of this patent is extended or adjusted under 35 U.S.C. 154(b) by 0 days.

(21) Appl. No.: 10/160,902

(22) Filed: May 31, 2002

(65) Prior Publication Data

US 2003/0010058 A1 Jan. 16, 2003

Related U.S. Application Data

(60) Provisional application No. 60/294,895, filed on May 31, 2001.

(51) Int. Cl.[7] ..... A44C 17/00
(52) U.S. Cl. ..... 63/32
(58) Field of Search ..... 63/32; D11/89, D11/90

(56) References Cited

U.S. PATENT DOCUMENTS

| | | | | | |
|---|---|---|---|---|---|
| 2,364,031 | A | | 11/1944 | Suderov | 63/32 |
| 3,286,486 | A | | 11/1966 | Huisman et al. | 63/32 |
| 3,585,764 | A | | 6/1971 | Huisman et al. | 51/283 |
| 3,763,665 | A | | 10/1973 | Polakiewicz | 63/32 |
| 3,788,097 | A | | 1/1974 | Elbe | 63/32 |
| 4,306,427 | A | | 12/1981 | Urban | 63/32 |
| 5,186,024 | A | | 2/1993 | Waters, Jr. | 63/32 |
| 5,462,474 | A | | 10/1995 | Hansen | 451/41 |
| 5,612,102 | A | | 3/1997 | Nakama | 428/15 |
| 5,657,647 | A | | 8/1997 | Freiesleben | 63/32 |
| D414,133 | S | | 9/1999 | Parker | D11/90 |
| D440,902 | S | * | 4/2001 | Wolf | D11/90 |
| D447,083 | S | * | 8/2001 | Rokah | D11/90 |
| D457,831 | S | * | 5/2002 | Kaufman | D11/90 |
| D458,183 | S | * | 6/2002 | Namdar | D11/90 |
| D463,316 | S | * | 9/2002 | Wolf | D11/90 |
| D469,035 | S | * | 1/2003 | Yuan | D11/90 |
| D476,256 | S | * | 6/2003 | Namdar | D11/90 |
| D478,528 | S | * | 8/2003 | Mehta et al. | D11/90 |

OTHER PUBLICATIONS

Www.efd.com website printout of Timeline Sep. 29, 2003.*
Website: www.drostes.com , Princess Cut Depth Percentage, (www.drostes.com/princess–depth.html) , May 30, 2002.
Website: www.drostes.com, Learn Princess Length to Width, (www.drostes.com/princess–lengthwidth.html), May 30, 2002.
Website: www.gemappraisers.com, Princess Cut, Princess Cut Chart, (www.gemappraisers.com/chrt4.htm), May 30, 2002.
Website: www.diamondscutters.com, How to Judge Shape—Princess, (www.diamoncutters.com/princess.html), May 30, 2002.

* cited by examiner

*Primary Examiner*—Robert J. Sandy
(74) *Attorney, Agent, or Firm*—Cohen, Pontani, Lieberman & Pavane

(57) ABSTRACT

A princess cut gemstone having a pavilion, a girdle, and a crown. In the presently preferred embodiment, the princess cut gemstone is a diamond with 101 facets: a pavilion of 64 facets, a girdle of 4 facets, and a crown with 33 facets (including the table).

23 Claims, 6 Drawing Sheets

PRINCESS CUT DIAMOND

RELATED APPLICATIONS

This application claims priority from U.S. Provisional Patent Application Serial No. 60/294,895 which was filed on May 31, 2001.

BACKGROUND OF THE INVENTION

1. Field of the Invention

This invention relates generally to faceted gemstone construction and, specifically, to the faceted construction of a princess cut diamond, where said faceted construction provides improved luster and appearance.

2. Description of the Related Art

Diamonds have fascinated and beguiled mankind for thousands of years, yet the exact history of the precious stone is unknown. The word "diamond" is derived from an ancient Greek verb meaning "I tame" or "I subdue". The ancient Greeks used this word for the hardest substance known, but it is difficult to tell what that substance was at that point in time—some believe the ancient Greeks may have been referring to the second hardest mineral, corundum (the gem variety of corundum is sapphire). Tracing the history of diamonds is complicated by this ambiguity with names.

The first diamonds were probably discovered around 800 BCE in riverbeds in India, and these alluvial deposits were rich enough to supply most of the world's supply until the eighteenth century, when India's dwindling supply probably spurred the exploration that led to the discovery of diamonds in Brazil, which became the next most important diamond source. In 1866, South Africa's massive diamond deposits were discovered, and a world-wide diamond rush was on. Currently, western Canada is the site of the world's newest diamond rush.

The cutting of diamonds into the complex formatted shapes we now associate with gems is a relatively recent practice. Although polishing and grinding with diamond dust was known from the thirteenth century, the first reference to diamond cutting is in 1550 in Antwerp, the most important diamond center of the period. Before the 1900's, the various shaped cuts of diamonds, such as the Table Cut, the Old Single Cut, the Rose Cut, and the European or Old Mine cut, varied widely in appearance. Because of the limitations of technology, these diamonds had very small tables, large culets, and short pavilion facets (definitions of these below); but there was no single widely-recognized or agreed-upon standard of cutting them. Until recently, a unified science and theory of facet proportion did not truly exist.

In 1919, diamond cutter Marcel Tolkowsky wrote a doctoral dissertation that essentially established the modern standard of a "brilliant-cut" diamond. Using only his own visual assessments of different variations of diamond cuts, Tolkowsky posited a theory of what cutting angles would produce the most proportionate balance of brilliance, scintillation, and dispersion in a gem-quality diamond. His measurements for achieving this balance were exact and strict. Fortuitously, improved cutting techniques and technology were being developed at the same time that finally allowed cutters to achieve more precise and stream-lined designs. Since that time, Tolkowsky's measurements have evolved into the looser "Ideal Cut" standard promulgated by the American Gem Society (AGS).

The round brilliant-cut diamond sets the standard for all other diamond shapes, and accounts for more than 75% of diamonds sold today. The "Ideal Cut" brilliant-cut diamond has 58 facets (or 57, if there is no culet), which are broken down as shown in FIGS. 1A (side view), 1B (top view), and 1C (bottom view). The terminology used for describing the parts of the brilliant-cut diamond is used for describing the basic components of all the cuts of diamonds.

As shown in the brilliant-cut diamond profile of FIG. 1A, there are three basic sections to a diamond: the crown 110, the girdle 120, and the pavilion 130. The girdle 120 is the narrow rim of the gemstone that separates the crown 110 from the pavilion 130. It is the section with the largest diameter of any part of the stone. Usually it is left in an unpolished state with a matte finish. However, to achieve more overall brilliance (described below), girdle 120 is often ground. Crown 110 and pavilion 130 can be understood as the "top" and "bottom", respectively, of the brilliant-cut diamond. The tiny facet on the pointed bottom of pavilion 130 is the culet 135. The large, flat top facet of crown 110 is the table 115.

As shown in the top view of FIG. 1B, the brilliant-cut diamond has 16 Upper Girdle facets 111, 8 Star facets 112, 8 Bezel facets 113, and 1 Table facet 115 in the crown 110, which totals 33 crown facets in all. As shown in the bottom view of FIG. 1C, the brilliant-cut diamond has 16 Lower Girdle facets 131, 8 Main Pavilion facets 132, and 1 culet 135 in the pavilion 130, which totals 24 pavilion facets in all. The culet 135 is merely the point at the bottom tip of pavilion 130, although the culet may sometimes be much larger. As seen from FIGS. 1A, 1B, and 1C, as well as Tables 1A and 1B below, the brilliant-cut diamond has 58 facets. These facets are further described in Tables 1A and 1B by the angle each of their flat planar surfaces form with a the horizontal plane of girdle 120.

TABLE 1A

Brilliant-Cut Diamond Crown Facets

| Ref. No. | Facet | Shape | Number | Angle |
|---|---|---|---|---|
| 111 | Upper Girdle | Triangle | 16 | ~32.2° to 36.8° |
| 112 | Star | Triangle | 8 | ~32.2° to 36.8° |
| 113 | Bezel | Kite | 8 | ~32.2° to 36.8° |
| 115 | Table | 8-sided polygon | 1 | 0° |

TABLE 1B

Brilliant-Cut Diamond Pavilion Facets

| Ref. No. | Facet | Shape | Number | Angle |
|---|---|---|---|---|
| 131 | Lower Girdle | Triangle | 16 | ~40.5° to 41° |
| 132 | Main Pavilion | Kite | 8 | ~40.5° to 41° |
| 135 | Culet | Point | 1 | ~98.5° |

There are certain dimensional characteristics of a any gemstone that are useful for ascertaining its overall value. Many of these characteristics are based in the proportions the various parts of the gemstone have to the overall width of the gemstone. Using the brilliant-cut diamond in FIG. 1A as an example, the crown height (or crown height percentage) is calculated by dividing the height of the crown 150 by the overall width 160 of the diamond. The table percentage (or table) is calculated by dividing the table's width 170 by the overall width 160 of the diamond. A table that is too large or too small will reduce the overall dispersion of a diamond's brilliance (these qualities will be described below). The depth percentage (or depth) is calculated as the ratio of the overall depth 180 of the diamond by the overall width 160 of the diamond. A depth that is too shallow or too deep will allow light to escape through the bottom of the stone, reducing the stone's overall brilliance and dispersion.

These various characteristics will be defined and described differently, depending on the type and shape of the stone being discussed. For example, the "Ideal Cut" characteristics of a brilliant-cut diamond are listed in Table 1C below.

TABLE 1C

Brilliant-Cut Diamond Dimensions

| Name | Dimensions | Value |
|---|---|---|
| Crown Height (Percentage) | Percentage of crown's height to the overall width of the diamond | ~15%–16.2% |
| Table Percentage | Percentage of table's width to the overall width of the diamond | ~52.4%–57.5% |
| Depth Percentage | Ratio of the overall depth of the diamond to the overall width of the diamond | ~59%–63% |

The features that describe the optical beauty of a diamond are: brilliance, dispersion, and scintillation. For a cut diamond, a feature of primary importance is its brilliance, which is essentially how much it shines. A diamond has a refractive index of 2.42, which is a very high value compared with that of other jewels (the index of crystal is 1.55; rubies and sapphires, 1.77). As a result (using the brilliant-cut diamond of FIG. 1A as an example), when rays of light incident on table 115 reach pavilion 130, most of the rays are reflected totally (i.e., the rays of light do not escape the diamond through pavilion 130, but are reflected inward again), and escape upon reaching crown 110, thereby reaching the observer's eyes as brilliance. The angles 131, 132, and 135 of pavilion 130 are important to total reflection, and thusly is important to the brilliance of a diamond.

The refractive index of the diamond also gives rise to the dispersion of the totally reflected rays of light into the seven colors of the visible light spectrum. This rainbow effect is sometimes called the fire of the stone. Scintillation is the glittering of the reflected light of a diamond caused by the movement of either the observer or the diamond itself. Scintillation depends primarily on the size of the diamond, the number of facets, the polish of the facets, and the accuracy of the angles of the respective facets. These features are somewhat subjective, and sometimes include luster, which is the quantity and quality of light reflecting from the surface of a diamond.

Diamonds are commonly assessed in terms of the "4 Cs": Cut, Clarity, Color, and Carat. Cut refers to both the geometric proportions of a gemstone and the final form into which the rough stone is shaped. The most prominent cuts in the industry are the brilliant-cut and the fancy shapes (which will be discussed more fully below). A good cut gives a diamond its brilliance, dispersion, and scintillation, in short, its appearance and appeal. Clarity is the measure by which a diamond is graded for purity, or whiteness. This is done by taking in the presence or absence of blemishes on the diamond's surface, or inclusions within the diamond. The professional grading scale is: flawless (F); internally flawless (IF); very, very slightly included (VV); very slightly included (VS); slightly included (SI); imperfect (I).

Color refers to the system of grading diamonds on the quality of their tint, from colorless to a pronounced yellow hue. Modern methods use letters to designate differences in colors. They are D–F, for colorless; G–J, for nearly colorless; K–M, for faintly yellow; N–R, for very light yellow; S–X, for light yellow; Y–Z, for yellow. The traditional method ascribes names to the variations in tint: pure white (extra river; river), top-white (wesselton), off-white (silver cape, tope cape, cape, dark cape), yellow, and brown. Carat is the unit of weight (equal to 200 milligrams) by which a diamond or other gemstone is measured. The word is derived from the carob bean, whose consistent weight was historically used to measure gemstones.

In the latter part of the last century, the fancy shape (or fancy cut) diamond cuts have proliferated. The fancy shape cuts include the oval, the marquise, the pear, the heart, the emerald, the princess, the trilliant, and the radiant. Some of the fancy shapes are better suited for retaining the maximum weight of the more flat forms of diamond rough (called macles or flats), and many are also cut from the less perfectly shapped octahedral and dodecahedral crystals. However, unlike the brilliant-cut diamond, the specific proportions that make up the "Ideal Cut" of most of the fancy shape diamonds have not been conclusively determined or published by either the AGS or the Gemological Institute of America (GIA). It is known that AGS is currently working on a classification standard for fancy cut gemstones.

The present invention is primarily directed to a princess cut diamond. As discussed above, the "ideal" proportions of this basically rectangular-shaped diamond do not have an industry-standard definition like the "Ideal Cut" proportions of the brilliant-cut (or other basically round-shaped) diamonds. A round diamond has a consistent pavilion angle that makes ideal proportions easier to establish as a depth percentage. A princess cut diamond has a pavilion that is made up of a variety of angles due to the unique pavilion shape and the variance in length and width.

A conventional princess cut diamond (sometimes referred to as a "square/rectangular modified brilliant" in GIA grading reports) is shown in FIGS. 2A and 2B. FIG. 2A is the top view of the crown; and FIG. 2B is the bottom view of the pavilion. Although this particular princess cut diamond is shown as square-shaped, the princess cut can be rectangle-shaped. In FIG. 2A, the crown has a total of 25 facets. There are 4 upper girdle facets 210 (right above the girdle), 4 bezel facets 220, 8 triangular star facets 230, and 4 triangular crown facets 240. In addition, there is one table facet 250 comprised of a 8-sided polygon, thus creating a total of 21 facets. These facets are listed in Table 2A. Please note that the angles are not listed, because there are no industry-standard ranges for these values.

TABLE 2A

Typical Princess Cut Diamond Crown Facets

| Ref. No. | Facet | Shape | Number |
|---|---|---|---|
| 210 | Upper Girdle | Rhomboid | 4 |
| 220 | Bezel | Kite | 4 |
| 230 | Star | Triangle | 8 |
| 240 | Crown | Triangle | 4 |
| 250 | Table | 8-sided polygon | 1 |

FIG. 2B is the view of the pavilion from the bottom of the conventional princess cut diamond. The pavilion has a total of 24 facets. There are 4 lower girdle facets 260 (located directly under the girdle). Making up the portions of the star-shaped sections of the pavilion are the 8 outer pavilion facets 270, the 8 inner pavilion facets, and the 4 main pavilion facets 290. The pavilion facets of the convention princess cut diamond are listed in Table 2B. Thus, combined with the 4 girdle facets (not shown in FIGS. 2A and 2B), the crown and pavilion facets make a total of 49 facets (50 facets if a culet is made/counted). Typical princess cut diamonds are either 50 facets or 58 facets (21 crown facets, 4 girdle facets, and 33 pavilion facets, including culet).

TABLE 2B

Typical Princess Cut Diamond Pavilion Facets

| Ref. No. | Facet | Shape | Number |
|---|---|---|---|
| 260 | Lower Girdle | Triangle | 4 |
| 270 | Outer Pavilion | Long Thin Triangle | 8 |
| 280 | Inner Pavilion | Long Thin Triangle | 8 |
| 290 | Main Pavilion | Kite | 4 |

As was indicated above, the characteristic proportions of the princess cut diamond are measured differently, and have different effects than, similar proportions of a brilliant-cut diamond. Like the brilliant-cut diamond, the crown height, table percentage, and depth percentage are all measured using the overall width of the diamond (at the girdle); however, because the princess cut may take on a rectangular shape (viewed from the top, like FIG. 2A), the "width" needs to be defined. If the right and left sides of the princess cut in FIG. 2A were longer than the top and bottom sides, the longer distance (from top to bottom) would be the length, and the shorter distance (from side to side) would be the width. The longer length measurement is not taken into consideration when calculating overall width.

The longer length measurement is taken into consideration in one of the more important characteristics of the princess cut diamond: the length-to-width ratio. The length-to-width ratio is determined by dividing the length measurement by the width measurement (on GIA reports, these distances are always calculated in hundredths of a millimeter). Length-to-width ratios in the range of 1:1 to 1.5:1 are considered better. The length-to-width ratio of a princess cut diamond is largely determined by the rough diamond crystal from which it is cut. When a rare fine quality diamond is cut by an experienced diamond cutter, the weight and value will never be sacrificed simply to change the diamond's length-to-width ratio if it is within the range of 1:1 to 1.5:1.

The princess cut diamond has a unique shape that is becoming increasingly popular with women for its beauty as well as its unique design capabilities. It is the only truly rectangular diamond shape that has a superior brilliance to the emerald cut. The effect and appearance of a princess cut diamond can be varied by altering the depth percentage and length-to-width ratios. The conventional depth percentage for a princess cut is between 65% and 80%. When a princess cut diamond is cut shallower than 65%, a greater percentage of light leaks out through the pavilion. When a princess cut diamond is cut deeper than 80%, the diamond appears darker in the center due to the large amount of light refracting through and out the bottom of the diamond.

Princess cut diamonds that are closer to square in measurement (i.e., with a length-to-width ratio close to 1:1) are typically more brilliant if the depth percentage is within a range of 65% to 75%. Princess cut diamonds with more rectangular shapes typically exhibit greater brilliance with depth percentages in the range of 70% to 80%. A summary of the typical values for a princess cut diamond are shown in Table 2C below.

TABLE 2C

Typical Princess Cut Diamond Dimensional Ranges

| Name | Dimensions | Value |
|---|---|---|
| Crown Height (Percentage) | Percentage of crown's height to the overall width of the diamond | ~5%–15% |
| Table Percentage | Percentage of table's width to the overall width of the diamond | ~56%–82% |
| Depth Percentage | Ratio of the overall depth of the diamond to the overall width of the diamond | ~53%–85% |
| Length-to-Width Ratio | Ratio of the overall length of the diamond to the overall width of the diamond | ~1:1–1.5:1 |

In the more well-established field of brilliant-cut (i.e, round) diamonds, diamond cutters have sought ways to increase the brilliance of the brilliant-cut diamond by exceeding the "Ideal Cut" 58 facets. For example, Huisman et al. (U.S. Pat. No. 3,286,486) took the "conventional twenty-four [pavilion] facets" of the brilliant-cut diamond and tripled them to create a pavilion with seventy-two facets. The greatly increased number of facets in the pavilion and the different angles at which a great many of them are cut result in enhanced brilliance. Nevertheless, Huisman et al. left the girdle and crown to be "of any conventional size". A later patent by the same inventors increased the number of facets of the girdle (Huisman et al. (U.S. Pat. No. 3,585,764)).

Other diamond cutters concentrated on other features besides brilliance. For example, Freiesleben (U.S. Pat. No. 5,657,647) reduces the number of crown facets in order to create large planar surfaces on the top of the diamond in order to "create an impression of calm and hardness". One diamond cutter sought to create greater dispersion (and the capability of highlighting colors) by etching fine grooves (0.1 $\mu$m to 1,000 $\mu$m) into the planar surfaces of the facets (Nakama (U.S. Pat. No. 5,612,102)). Another diamond cutter sought greater scintillation by making the number of mid-level pavilion facets an odd number rather than the standard even number of facets (Elbe (U.S. Pat. No. 3,788,097).

These attempts to increase the value and beauty of the brilliant-cut diamond have met with varying degrees of success, but there are always new brilliant cuts being developed and experimented with in order to improve the features of brilliance, dispersion, and scintillation. Similarly, in the relatively new field of princess cut diamonds, princess cuts need to be developed which uniquely maximize and balance the features of brilliance, dispersion, and scintillation of the princess cut diamond. Although very broad ranges of certain diamond characteristics have been recognized in the field of princess cut diamonds, there is the need to find the right combination of the various attributes (the number and shape of pavilion and crown facets, the various characteristic percentages, etc.) to uniquely bring forth the brilliance, dispersion, and scintillation of the diamond.

SUMMARY OF THE INVENTION

One object of the present invention is to provide a new and unique princess cut gemstone which maximizes and balances the features of brilliance, dispersion, and scintillation of a gemstone.

Another object of the present invention is to provide a princess cut gemstone with an increased number of facets (in comparison to the typical princess cut) to increase the brilliance, dispersion, and scintillation of the gemstone.

Yet another object of the present invention is to provide a novel combination of the various gemstone attributes (the number and shape of pavilion and crown facets, the characteristic percentages, etc.) to uniquely bring forth the brilliance, dispersion, and scintillation of the gemstone.

These and other objects are achieved by a princess cut gemstone according to the present invention. The novel princess cut gemstone comprises a crown, a girdle, and a pavilion. In the presently preferred embodiment, the crown comprises 8 side crown facets, 24 star crown facets, and a table facet. The pavilion comprises 20 side pavilion facets and 44 star pavilion facets. The girdle comprises 4 girdle facets.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENT

The present invention comprises a new and unique combination of pavilion, girdle, and crown facets which provide a unique balance of brilliance, scintillation, and dispersion. According to the present invention, the number of facets is greatly increased from the typical number of facets, thereby increasing the brilliance, dispersion, and scintillation of the diamond. Thus, diamonds with inferior clarity and/or color may be cut in such a manner as to conceal the inferior clarity and/or color through the heightened brilliance and scintillation caused by the present invention.

In the presently preferred embodiment, a princess cut diamond has a total of 101 facets: 33 crown facets (including the table); 4 girdle facets, and 64 pavilion facets. The facets may be formed by any method known to those skilled in the art. Table 3 below lists the total number of facets in the presently preferred embodiment.

TABLE 3

Total Facets of the Preferred Embodiment

| Facet | Number |
|---|---|
| Crown | 32 |
| (includ. Table) | (+1) |
| Girdle | 4 |
| Pavilion | 64 |
| Total: | 101 |

Figure 1A:
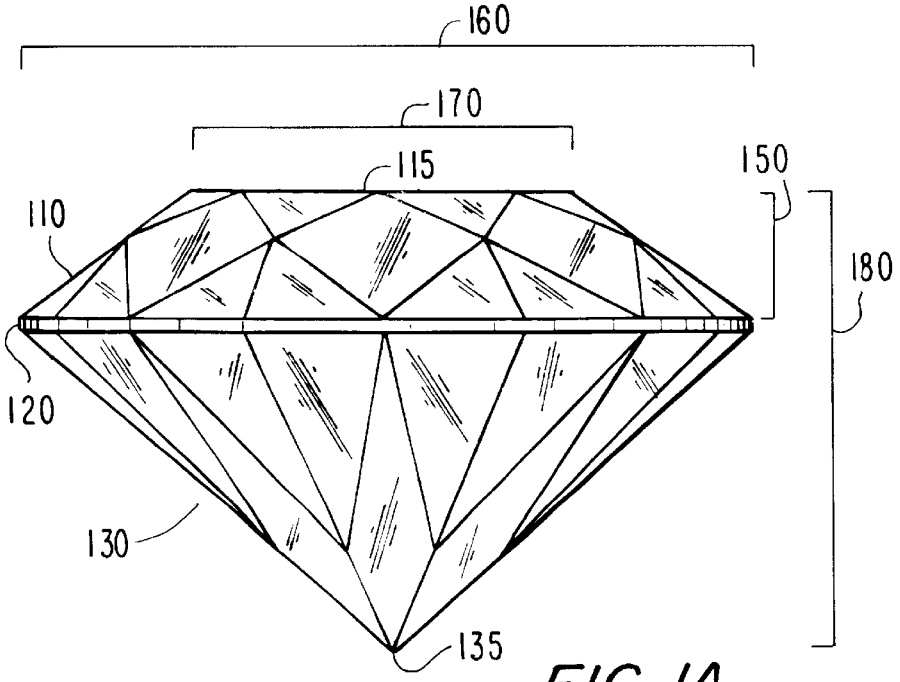
FIG. 1A (PRIOR ART)
FIG. 1A is a side view of a prior art brilliant-cut diamond.
Figure 1B:
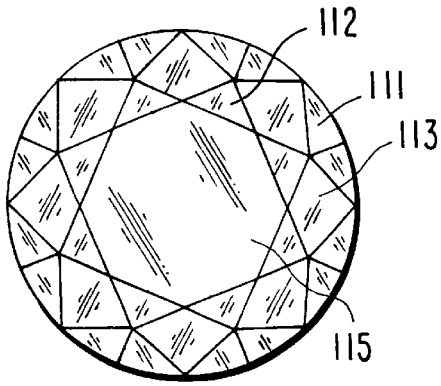
FIG. 1B (PRIOR ART)
FIG. 1B is a top view of a prior art brilliant-cut diamond.
Figure 1C:
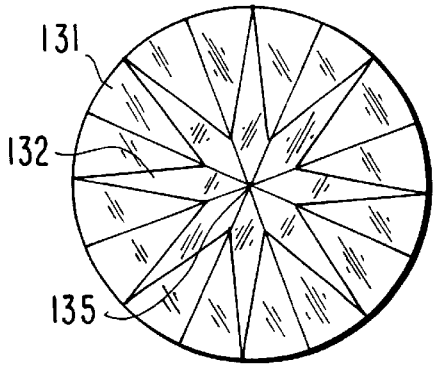
FIG. 1C (PRIOR ART)
FIG. 1C is a bottom view of a prior art brilliant-cut diamond.
Figure 2A:
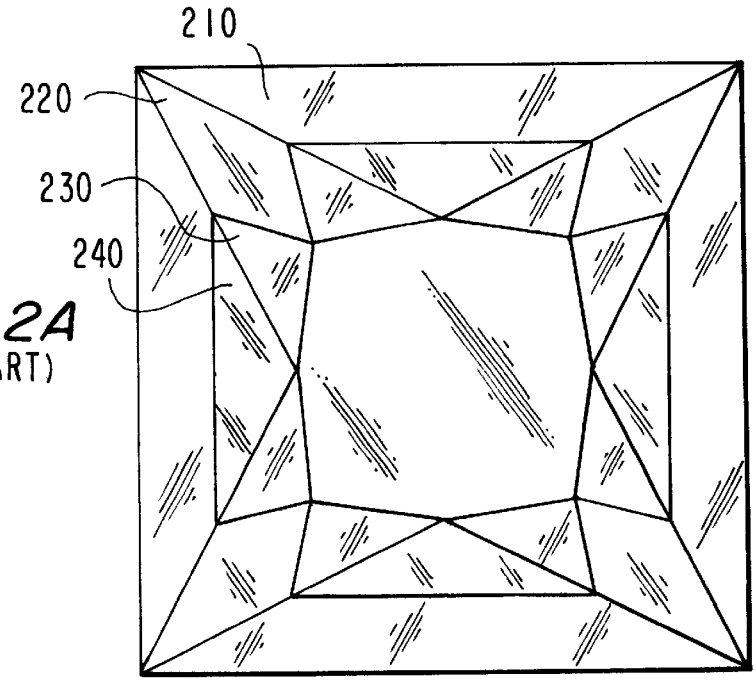
FIG. 2A (PRIOR ART)
FIG. 2A is a top view of a prior art princess cut diamond.
Figure 2B:
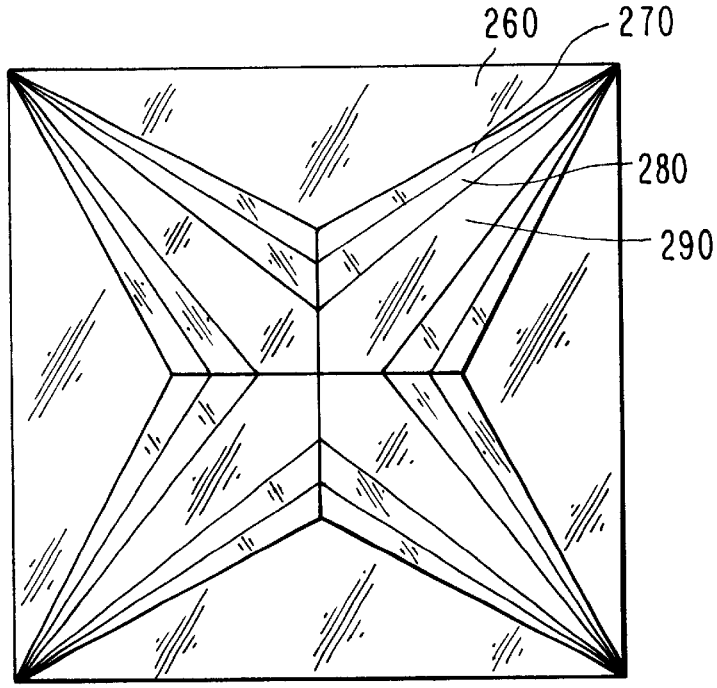
FIG. 2B (PRIOR ART)
FIG. 2B is a bottom view of a prior art princess cut diamond.
Figure 3A:
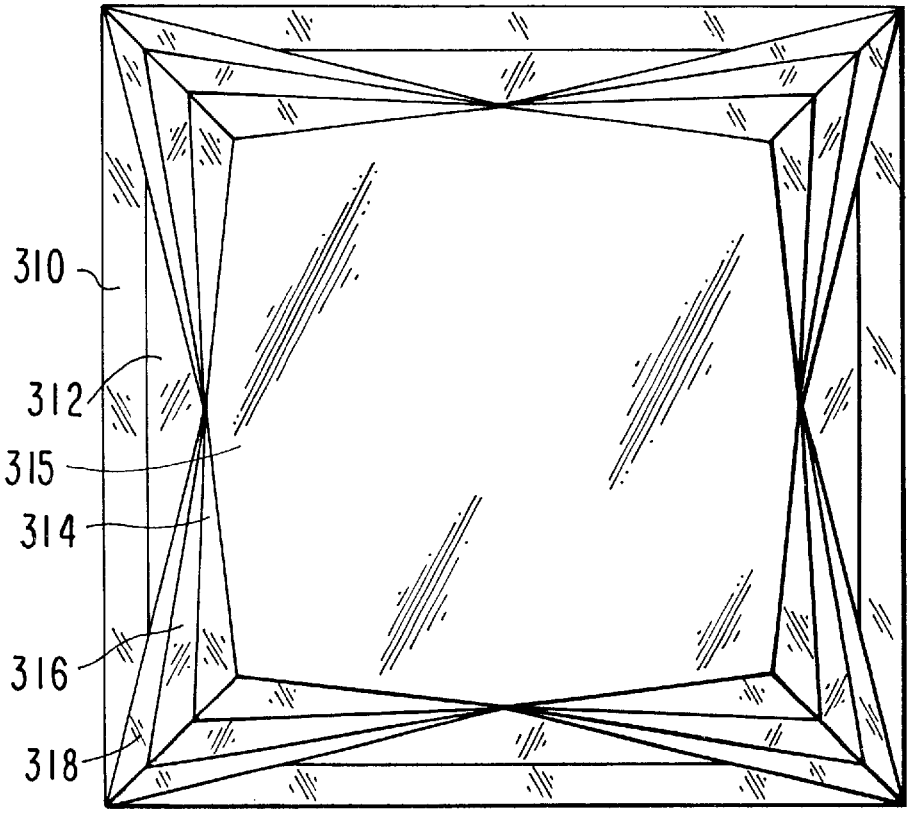
FIG. 3A is a top view of the crown of a princess cut diamond according to the presently preferred embodiment of the present invention.
Figure 3B:
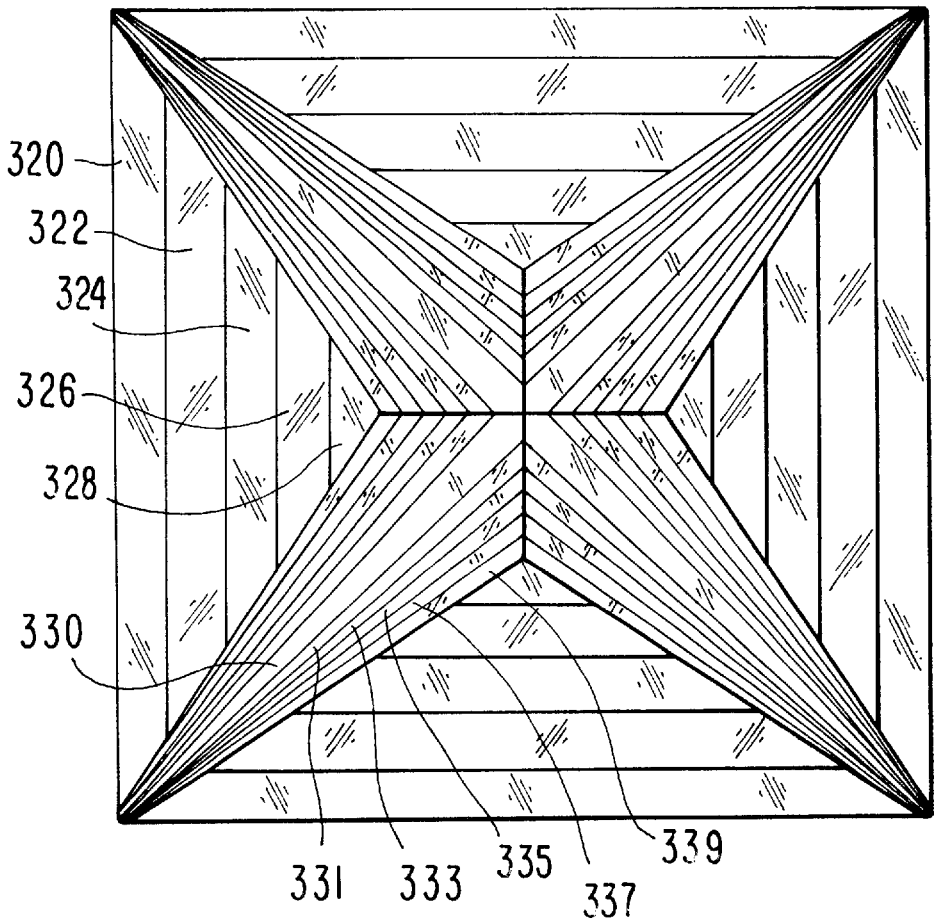
FIG. 3B is a bottom view of the pavilion of a princess cut diamond according to the presently preferred embodiment of the present invention.
Figure 3C:
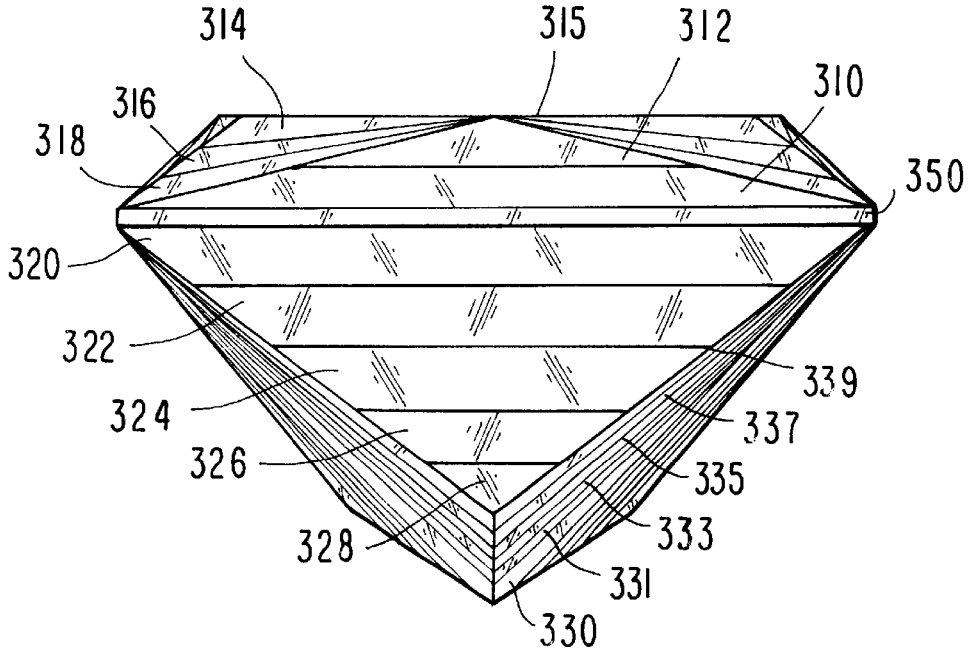
FIG. 3C is a side view of a princess cut diamond according to the presently preferred embodiment of the present invention.
Figure 4:
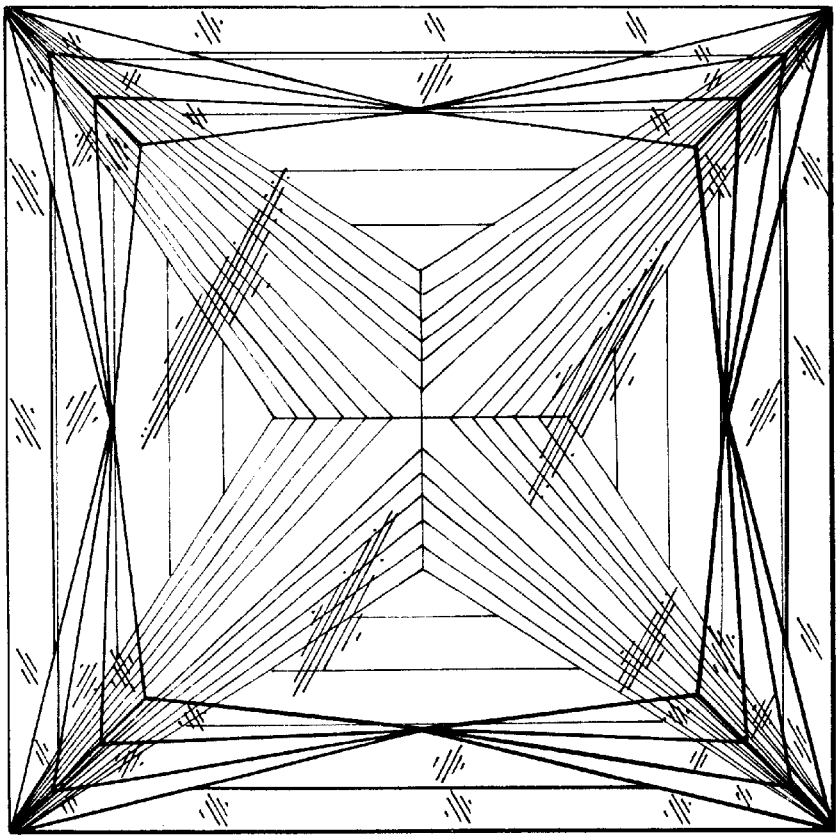
FIG. 4 is a top view of a princess cut diamond according to the presently preferred embodiment of the present invention, where the facets of the pavilion (in lighter lines) on the bottom of the princess cut diamond can be seen.

FIGS. 3A, 3B, and 3C show the construction of the princess cut diamond according to the presently preferred embodiment of the present invention. FIG. 3A is a top view of the princess cut diamond, showing the 33 crown facets. FIG. 3B is a bottom view of the princess cut diamond, showing the 64 pavilion facets. FIG. 3C is a side view of the princess cut diamond, showing one of the 4 girdle facets as well as portions of the pavilion and crown facets.

FIG. 3A shows the 33 crown facets, as listed below in Table 3A. These facets can be broken down into two sections: the facets which form the shape of a four-pointed star and the facets forming the remaining four sides. The side facets comprise 4 substantially rhomboidal lower side crown facets 310 directly above the girdle, with 4 substantially triangular upper side crown facets 312 directly above the lower side crown facets 310. In the facets making up the four points in the star-shaped portion of the crown, there are 8 substantially triangular inner star crown facets 314, 8 substantially triangular middle star crown facets 316, and 8 substantially triangular outer star crown facets 318. Lastly, there is the table facet 315 consisting of an eight-sided polygon. All of the crown facets can be further described by the angle each of their flat planar surfaces form with a plane parallel to the horizontal plane of girdle 350 in FIG. 3C. These angles are also listed in Table 3A.

TABLE 3A

Preferred Princess Cut Diamond Crown Facets

| Ref. No. | Facet | Shape | Number | Angle |
|---|---|---|---|---|
| 310 | Lower Side | Rhomboid | 4 | 39.5°–40.5° |
| 312 | Upper Side | Triangle | 4 | 36.5°–37.5° |
| 314 | Inner Star | Triangle | 8 | 31.5°–32.5° |
| 316 | Middle Star | Triangle | 8 | 34.5°–35.5° |
| 318 | Outer Star | Triangle | 8 | 35.5°–36.5° |
| 315 | Table | 8-sided polygon | 1 | 0° |

FIG. 3B shows the 64 pavilion facets, as listed below in Table 3B. Similar to the crown, the facets in the pavilion can be broken down into the facets which form the shape of a four-pointed star, and the remaining facets which make up the four sides. The facets forming the four-pointed star shape are the central star pavilion facets 330 and a series of facets radiating out from the long edges of the central star pavilion facets. The remaining side facets comprise 4 substantially rhomboidal first side pavilion facets 320 directly below the girdle, with a series of side pavilion facets adjoining each other: 4 substantially rhomboidal second side pavilion facets 322; 4 substantially rhomboidal third side pavilion facets 324; 4 substantially rhomboidal fourth side pavilion facets 326; and 4 substantially triangular fifth side pavilion facets 328.

In the facets making up the four corners of the star-shaped pattern in the pavilion in FIG. 3B, there are 4 substantially kite-shaped central star pavilion facets 330 extending from the culet to the girdle 350 of the princess cut diamond. On the sides of each central star pavilion facet 330 are five sets of two star pavilion facets of the same degree (one on each side). There are 8 substantially triangular first degree star pavilion facets 331, 8 substantially triangular second degree star pavilion facets 333, 8 substantially triangular third degree star pavilion facets 335, 8 substantially triangular fourth degree star pavilion facets 337, and 8 substantially triangular fifth degree star pavilion facets 339. All of the pavilion facets can be further described by the angle each of their flat planar surfaces form with a plane parallel to the horizontal plane of girdle 350 in FIG. 3C. These angles are also listed in Table 3B.

TABLE 3B

Preferred Princess Cut Diamond Pavilion Facets

| Ref. No. | Facet | Shape | Number | Angle |
|---|---|---|---|---|
| 320 | First Side | Rhomboid | 4 | 63°–64° |
| 322 | Second Side | Rhomboid | 4 | 60°–61° |
| 324 | Third Side | Rhomboid | 4 | 57°–58° |
| 326 | Fourth Side | Rhomboid | 4 | 54°–55° |
| 328 | Fifth Side | Triangle | 4 | 51°–52° |
| 330 | Central Star | Long, Thin Kite | 4 | 61°–62° |
| 331 | First Degree Star | Long, Thin Triangle | 8 | 57°–58° |
| 333 | Second Degree Star | Long, Thin Triangle | 8 | 55°–56° |
| 335 | Third Degree Star | Long, Thin Triangle | 8 | 53°–54° |
| 337 | Fourth Degree Star | Long, Thin Triangle | 8 | 50°–51° |
| 339 | Fifth Degree Star | Long, Thin Triangle | 8 | 48°–49° |

The characteristic proportions of the presently preferred embodiment of the princess cut diamond according to the present invention are shown below in Table 3C.

TABLE 3C

Princess Cut Diamond Dimensions

| Name | Dimensions | Value |
|---|---|---|
| Crown Height (Percentage) | Percentage of crown's height to the overall width of the diamond | 8%–14% |
| Table Percentage | Percentage of table's width to the overall width of the diamond | 65%–85% |
| Depth Percentage | Ratio of the overall depth of the diamond to the overall width of the diamond | 62%–75% |
| Length-to-Width Ratio | Ratio of the overall length of the diamond to the overall width of the diamond | 1:1 to 1.3:1 |

Although the presently preferred embodiment has a particular number of facets, there is the possibility of variation, as would be known by one skilled in the art. For example, the number of side facets on the pavilion or the crown could be varied (e.g., three side pavilion facets on each side of the pavilion rather than five, or one single side crown facet on each side of the crown rather than two). As another example, a larger flat culet could be formed on the bottom of the pavilion. As yet another example, the number of girdle facets could be doubled and the four main sides of the princess cut diamond could each be split in the center in a manner imitating the four main sides of the table facet. Similarly, the number of edges on the table facet could be halved or doubled.

In addition, the values in Tables 3, 3A, 3B, and 3C should be understood as preferred values; thus, other embodiments of the present invention may have one or more characteristics or qualities outside the ranges listed in Tables 3, 3A, 3B, and 3C. For example, although the table percentage is listed as falling in the range of 65%–85% in Table 3C, it should be understood that an embodiment of the present invention may have a table percentage with a value of 54% or 87%.

As evidenced by the description above and illustrated in FIGS. 3A through 3C and Tables 3 through 3C, the construction of the present invention has numerous advantages over the prior art. Greater scintillation is caused by the greater number of facets, both in the pavilion and crown, than the typical princess cut diamond, and the different angles and sizes of the facets. Greater brilliance results from the greater number of facets in the pavilion than the typical princess cut diamond, as well as the uniquely different angles, shapes, and relative sizes of the facets. A unique appearance is created by the unique balance of brilliance, scintillation, and dispersion caused by the inventive and novel construction. In addition, the unique angles and sizes of the facets combine to achieve a more flowing design.

Furthermore, because of the increased brilliance and scintillation, the present inventive cut may be used on diamonds with inferior clarity and/or color in order to heighten their appearance and luster and to hide their imperfections. For example, the present invention may be used to conceal inclusions or carbon spots inside an inferior diamond, thereby increasing its demand and hence, its worth.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A princess cut gemstone comprising:

a crown;

a girdle comprising four girdle facets; and a pavilion comprising forty-four star pavilion facets in substantially the shape of a four-pointed star, wherein said forty-four star pavilion facets comprise:

four substantially kite-shaped central star pavilion facets, each of said four central star pavilion facets having a wide triangular end formed of two small edges and a narrow end formed of two long edges, wherein the point at the corner of the wide triangular end forms the bottom point of the pavilion and each small edge is shared with another central star pavilion facet;

eight substantially triangular first degree star pavilion facets, each of said eight first degree star pavilion facets having a short side shared with another first degree star pavilion facet, and a long side shared with one of said eight central star pavilion facets;

eight substantially triangular second degree star pavilion facets, each of said eight second degree star pavilion facets having a short side shared with another second degree star pavilion facet, and a long side shared with one of said eight first degree star pavilion facets;

eight substantially triangular third degree star pavilion facets, each of said eight third degree star pavilion facets having a short side shared with another third degree star pavilion facet, and a long side shared with one of said eight second degree star pavilion facets;

eight substantially triangular fourth degree star pavilion facets, each of said eight fourth degree star pavilion facets having a short side shared with another fourth degree star pavilion facet, and a long side shared with one of said eight third degree star pavilion facets; and eight substantially triangular fifth degree star pavilion facets, each of said eight fifth degree star pavilion facets having a short side shared with another fifth degree star pavilion facet, and a long side shared with one of said eight fourth degree star pavilion facets.

2. The gemstone as recited in claim 1, wherein said pavilion further comprises:

four substantially rhomboidal first side pavilion facets, each one sharing its longest edge with the girdle;

four substantially rhomboidal second side pavilion facets, each one sharing its longest edge with one of said four first side pavilion facets;

four substantially rhomboidal third side pavilion facets, each one sharing its longest edge with one of said four second side pavilion facets;

four substantially rhomboidal fourth side pavilion facets, each one sharing its longest edge with one of said four third side pavilion facets; and four substantially triangular fifth side pavilion facets, each one sharing its longest edge with one of said four fourth side pavilion facets, and a point opposite its longest edge.

3. The gemstone as recited in claim 1, wherein:

each of the four substantially kite-shaped central star pavilion facets has a planar face which forms an angle in a range of about 61°–62° with a horizontal plane of the girdle;

each of the eight substantially triangular first degree star pavilion facets has a planar face which forms an angle in a range of about 57°–58° with the horizontal plane of the girdle;

each of the eight substantially triangular second degree star pavilion facets has a planar face which forms an angle in a range of about 55°–56° with the horizontal plane of the girdle;

each of the eight substantially triangular third degree star pavilion facets has a planar face which forms an angle in a range of about 53°–54° with the horizontal plane of the girdle;

each of the eight substantially triangular fourth degree star pavilion facets has a planar face which forms an angle in a range of about 50°–51° with the horizontal plane of the girdle; and each of the eight substantially triangular fifth degree star pavilion facets has a planar face which forms an angle in a range of about 48°–49° with the horizontal plane of the girdle.

4. The gemstone as recited in claim 2, wherein:

each of the four substantially rhomboidal first side pavilion facets has a planar face which forms an angle in a range of about 63°–64° with a horizontal plane of the girdle;

each of the four substantially rhomboidal second side pavilion facets has a planar face which forms an angle in a range of about 60°–61° with the horizontal plane of the girdle;

each of the four substantially rhomboidal third side pavilion facets has a planar face which forms an angle in a range of about 57°–58° with the horizontal plane of the girdle;

each of the four substantially rhomboidal fourth side pavilion facets has a planar face which forms an angle in a range of about 54°–55° with the horizontal plane of the girdle; and each of the four substantially triangular fifth side pavilion facets has a planar face which forms an angle in a range of about 51°–52° with the horizontal plane of the girdle.

5. The gemstone as recited in claim 1, wherein the princess cut gemstone is a diamond.

6. The gemstone as recited in claim 1, wherein the crown height percentage of the princess cut gemstone is in a range of about 8% to 14%.

7. The gemstone as recited in claim 1, wherein the table percentage of the princess cut gemstone is in a range of about 65% to 85%.

8. The gemstone as recited in claim 1, wherein the depth percentage of the princess cut gemstone is in a range of about 62% to 75%.

9. The gemstone as recited in claim 1, wherein the length-to-width ratio of the princess cut gemstone is in a range of about 1:1 to 1.3:1.

10. The gemstone as recited in claim 1, wherein the crown comprises:

four substantially rhomboidal lower side crown facets, each one having a longest edge positioned adjacent to the girdle, and a second edge opposite its longest edge;

four substantially triangular upper side crown facets, each one having a longest edge positioned adjacent to the second edge of one of the four girdle facets, and a point opposite its longest edge;

a table facet in the shape of a eight-sided polygon, wherein four of the points of the eight-sided polygon are the points of the 4 upper side crown facets; and twenty-four star crown facets in substantially the shape of the four points of a star, wherein said twenty-four star crown facets comprise:

eight substantially triangular inner star crown facets, each having an inner edge shared with one of the eight edges of the table facet, and a side edge shared with another inner star facet;

eight substantially triangular middle star crown facets, each having an inner edge shared with one of said eight inner star crown facets, and a side edge shared with another middle star facet; and substantially triangular outer star crown facets, each having an inner edge shared with one of said eight middle star crown facets, and a side edge shared with another outer star facet.

11. A princess cut gemstone comprising:

a pavilion;

a girdle comprising four girdle facets; and a crown comprising twenty-five star crown facets in substantially the shape of a four-pointed star, wherein the twenty-five star crown facets comprise:

a table facet in the shape of an eight-sided polygon, said table facet forming the center of the four-pointed star shape;

eight substantially triangular inner star crown facets, each having an inner edge shared with one of the eight edges of the table facet, and a side edge shared with another inner star crown facet;

eight substantially triangular middle star crown facets, each having an inner edge shared with the one of said eight inner star crown facets, and a side edge shared with another middle star crown facet; and eight substantially triangular outer star crown facets, each having an inner edge shared with one of said eight middle star crown facets, and a side edge shared with another outer star crown facet.

12. The gemstone as recited in claim 11, wherein the crown further comprises:

four substantially rhomboidal lower side crown facets, each one sharing a longest edge with the girdle, and a second edge opposite its longest edge; and four substantially triangular upper side crown facets, each one sharing the second edge of one of the four lower side crown facets.

13. The gemstone as recited in claim 11, wherein:

each of the eight substantially triangular inner star crown facets has a planar face which forms an angle in a range of about 31.5°–32.5° with the horizontal plane of the girdle;

each of the eight substantially triangular middle star crown facets has a planar face which forms an angle in a range of about 34.5°–35.5° with the horizontal plane of the girdle; and each of the eight substantially triangular outer star crown facets has a planar face which forms an angle in a range of about 35.5°–36.5° with the horizontal plane of the girdle.

14. The gemstone as recited in claim 12, wherein:

each of the four substantially rhomboidal lower side crown facets has a planar face which forms an angle in a range of about 39.5°–40.5° with a horizontal plane of the girdle; and each of the four substantially triangular upper side crown facets has a planar face which forms an angle in a range of about 36.5°–37.5° with the horizontal plane of the girdle.

15. The gemstone as recited in claim 11, wherein the princess cut gemstone is a diamond.

16. The gemstone as recited in claim 11, wherein the crown height percentage of the princess cut gemstone is in a range of about 8% to 14%.

17. The gemstone as recited in claim 11, wherein the table percentage of the princess cut gemstone is in a range of about 65% to 85%.

18. The gemstone as recited in claim 11, wherein the depth percentage of the princess cut gemstone is in a range of about 62% to 75%.

19. The gemstone as recited in claim 11, wherein the length-to-width ratio of the princess cut gemstone is in a range of about 1:1to 1.3:1.

20. The gemstone as recited in claim 11, wherein the pavilion comprises forty-four star pavilion facets in substantially the shape of a four-pointed star, wherein said forty-four star pavilion facets comprise:

four substantially kite-shaped central star pavilion facets, each of said four central star pavilion facets having a wide triangular end formed of two small edges and a narrow end formed of two long edges, wherein the point at the corner of the wide triangular end forms the bottom point of the pavilion and each small edge is shared with another central star pavilion facet;

eight substantially triangular first degree star pavilion facets, each of said eight first degree star pavilion facets having a short side shared with another first degree star pavilion facet, and a long side shared with one of said eight central star pavilion facets;

eight substantially triangular second degree star pavilion facets, each of said eight second degree star pavilion facets having a short side shared with another second degree star pavilion facet, and a long side shared with one of said eight first degree star pavilion facets;

eight substantially triangular third degree star pavilion facets, each of said eight third degree star pavilion facets having a short side shared with another third degree star pavilion facet, and a long side shared with one of said eight second degree star pavilion facets;

eight substantially triangular fourth degree star pavilion facets, each of said eight fourth degree star pavilion facets having a short side shared with another fourth degree star pavilion facet, and a long side shared with one of said eight third degree star pavilion facets; and eight substantially triangular fifth degree star pavilion facets, each of said eight fifth degree star pavilion facets having a short side shared with another fifth degree star pavilion facet, and a long side shared with one of said eight fourth degree star pavilion facets.

21. The gemstone as recited in claim 1, wherein the short and long sides of each first, second, third, fourth, and fifth degree star pavilion facet form angles having a first value, wherein angles formed at the narrow end of each of the four central star pavilion facets have a second value, and wherein said second value is greater than said first value.

22. The gemstone as recited in claim 1, wherein each of the first, second, third, fourth, and fifth degree star pavilion facets comprise a third side, wherein a length of each of said third sides has a first value, wherein a length of each of the two small edges of each of the four central star pavilion facets has a second value, and wherein said second value is substantially equal to, or greater than, said first value.

23. The gemstone as recited in claim 1, wherein a length of the greatest width formed between the two long edges of each of the four central star pavilion facets has a first value, wherein a length of the greatest width formed between the long and short sides of each of the first, second, third, fourth, and fifth degree star pavilion facets has a second value, and wherein said first value is greater than said second value.

* * * * *